United States Patent [19]

Sigerist

[11] Patent Number: 4,603,528

[45] Date of Patent: Aug. 5, 1986

[54] PANEL INSTALLATION

[75] Inventor: Helmut Sigerist, Fort Langley, Canada

[73] Assignee: Venturetech Enterprises, Inc., Vancouver, Canada

[21] Appl. No.: 751,066

[22] Filed: Jul. 2, 1985

[51] Int. Cl.[4] ..... E04C 1/34

[52] U.S. Cl. ..... 52/464; 52/468; 52/471; 52/586

[58] Field of Search ..... 52/312, 471, 779, 586, 52/466, 472, 470, 468, 512, 513, 464, 461

[56] References Cited

U.S. PATENT DOCUMENTS

| | | | |
|---|---|---|---|
| 1,417,102 | 5/1922 | Nyman | 52/312 |
| 1,430,996 | 10/1922 | Horlin | 52/468 |
| 1,749,648 | 3/1930 | Ray | 52/464 |
| 1,794,158 | 2/1931 | Dieterich | 52/779 |
| 2,116,846 | 5/1938 | Pilcher | 52/312 |
| 2,316,035 | 4/1943 | Westrope | 52/312 |
| 3,080,021 | 3/1963 | Muir | 52/471 |
| 3,363,382 | 1/1968 | Forrest | 52/464 |
| 3,412,515 | 11/1968 | Finon | 52/779 |
| 3,530,633 | 9/1970 | Scott | 52/464 |
| 3,550,340 | 12/1970 | Klein | 52/312 |

FOREIGN PATENT DOCUMENTS

| | | | |
|---|---|---|---|
| 1104493 | 11/1955 | France | 52/779 |
| 351369 | 6/1931 | United Kingdom | 52/312 |

*Primary Examiner*—John E. Murtagh

*Attorney, Agent, or Firm*—Kolisch, Hartwell & Dickinson

[57] ABSTRACT

A panel installation comprising a layer of panel pieces supported on a supporting surface. An anchoring element secures adjacent pieces to the supporting surface which has wing flanges seated in slots presented by adjacent panel pieces. A cover strip seats within a receptor channel defined in an anchoring element.

6 Claims, 4 Drawing Figures

PANEL INSTALLATION

BACKGROUND AND SUMMARY OF THE INVENTION

This invention relates to a panel installation, where panels are installed in layered relation to cover a supporting surface such as, and by way of example, the side or ceiling of a room. The invention more particularly concerns such an installation which features an anchoring element used to secure edge margins of adjacent panels in place, the anchoring element being secured by nailing or with other fasteners to the supporting surface and including laterally extending wing flanges which extend into grooves provided in edge margins of the panels mounted through the anchoring element.

The panel installation contemplated is very flexible in use, in that such may be employed to install panels or panel pieces on flat surfaces, curved surfaces, upstanding wall surfaces, or on ceilings. The panel pieces that are mounted with the installation may take varying forms or shapes. For instance, these pieces may be wood, overlaid foam plastic, or of particle board construction. The panel pieces may have varying widths depending upon the esthetic effect desired. Fasteners used in securing anchoring elements employed in the installation are concealed in the final installation. Components used in making the panel installation are produceable at low cost. For instance, major components may take the form of plastic extrusions.

A general object of the invention, therefore, is to provide a novel form of panel installation which is flexible in use, and which provides, with completion of the installation, a pleasing visual affect.

Another object is to provide a form of panel installation which can be rapidly installed.

A further object is to provide a panel installation which is adaptable to cover flat as well as curving surfaces.

A more specific object is to provide a panel installation which utilizes an anchoring element, and a cover strip which is received by the anchoring element, both of which may take the form of easily produced extrusions.

With the organization contemplated various visual affects are possible.

A particular feature and advantage of the invention is that in a completed installation, a degree of air circulation is permitted behind the panels which have been installed, advantageous where moisture conditions are a problem.

These and other objects and advantages are obtained by the invention, which is described hereinbelow in more detail, in conjunction with the accompanying drawings, wherein.

Figure 1:
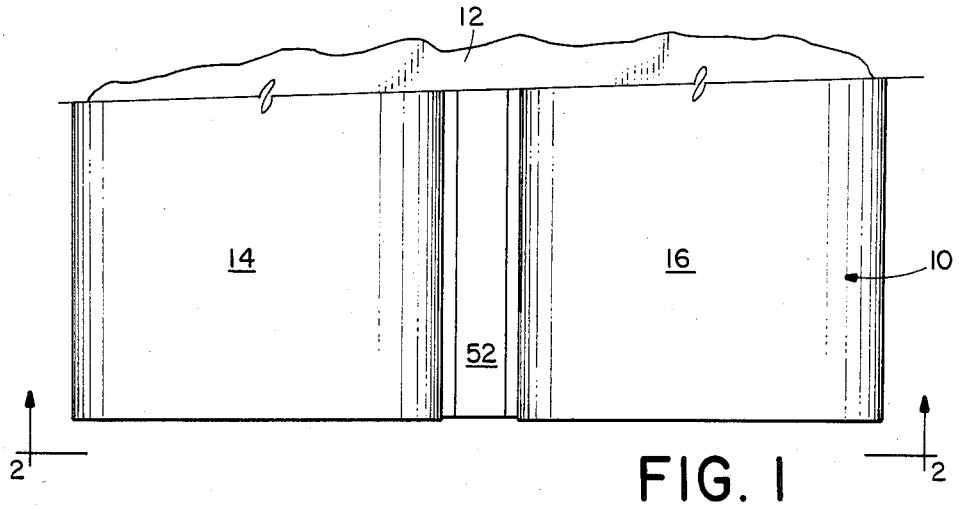
FIG. 1 is a side elevation of portions of a wall surface covered with a panel installation as contemplated herein.

As illustrated in the drawings, a panel installation partially, shown at 10, is secured to a supporting surface, such as a surface of an upstanding wall, partially shown at 12. The panel installation includes multiple panels or panel pieces disposed in layered relation over the wall surface, with one piece, exemplified by panel piece 14, being adjacent another panel piece, such as panel piece 16.

The panel pieces have essentially parallel opposite side margins, indicated for panel piece 14 at 14*a* and 14*b*, and for piece 16 at 16*a* and 16*b*. In the form of the invention illustrated in FIGS. 1, 2, adjacent panel pieces are laterally spaced a slight distance from each other.

Figure 3:
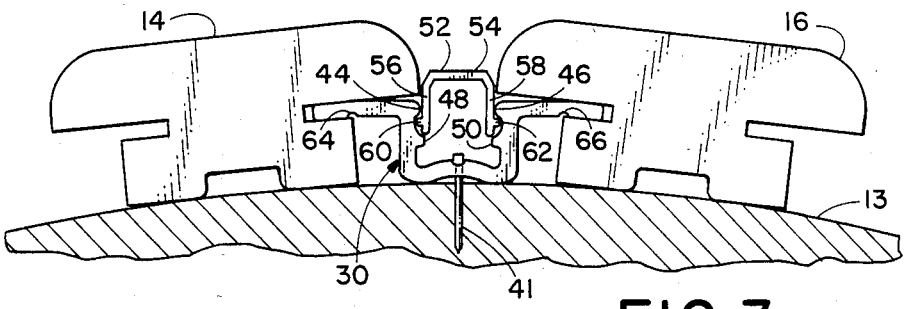
FIG. 3 is a view similar to FIG. 2, but showing how the installation may be prepared over a curved surface.

Further considering the construction of a panel piece, each has slots, exemplified by slots 20, 22, extending along each of its opposite side margins and indented inwardly from the side margins. Preferably, the side margins of a panel piece are recessed along the length of the piece where meeting with the back side of the piece. This is demonstrated by portion 24 of side margin 14*a* which is recessed inwardly from the remainder of side margin 14*a* and which joins with the back side 26 of the panel piece. Additionally, it is preferred that the back side of the panel piece have a groove or grooves extending therealong as exemplified by the groove shown at 28. Because of the recesses in the side margins described, ample room is provided for the installation of an anchoring element used in securing panel pieces to the supporting surface, as will be later more fully discussed. This clearance is provided, whether the pieces are mounted on a flat surface, or on a curved surface, as illustrated in FIG. 3 at 13. Additionally, paths are provided for the circulation of air over the backs sides of the panel pieces. The grooves also accommodate such air circulation.

Another result of the provision of the grooves, and the recesses in the side edges, is to substantially reduce the contact areas that the back sides of the panel pieces have with any supporting surface. This tends to minimize the destabilizing effects of unevenness in a wall surface. Additionally, with the panel pieces arranged over a curvecd surface, the panel pieces tend to seek a position fully supported on the surface.

The panel pieces may be composed of wood, or may have a particle board type of construction. Alternatively, they may be made of a foam plastic and provided with an attractive overlay such as a veneer overlay adhered to the outer sides of the pieces.

The panel pieces are secured to the supporting surface through the provision of what is referred to herein as an anchoring element 30.

Figure 2:
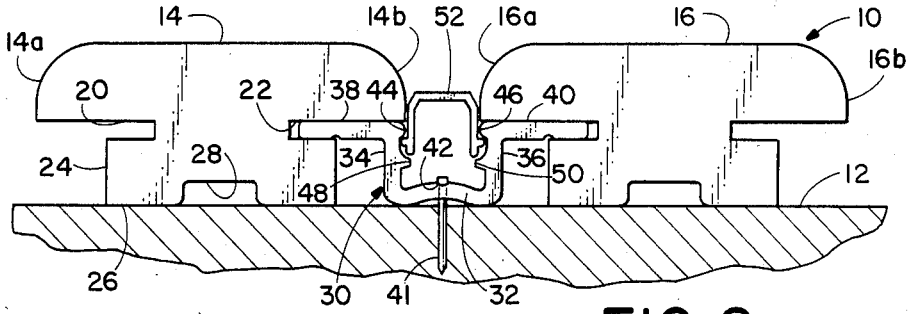
FIG. 2 is an end view of the installation, taken generally along the line 2—2 in FIG. 1.

The particular anchoring element illustrated in FIGS. 2 and 3 comprises and elongate plastic extrusion. The extrusion includes a base or base web 32 which sits against the support surface. Integral with opposite side margins of this base are opposed upstanding flange portions 34, 36. The base and flange portions together define what is referred to herein as an elongate receptor channel which faces outwardly from the support surface. Elongate wing flanges 38, 40 are integrally joined to the upper margins of flange portions 34, 36, and these extend laterally outwardly in the anchoring element.

The base of the anchoring element has a concave bottom face which faces the support surface. Furthermore, the top surface of base 32 has a groove 42 extending therealong. To secure the adjustment margins of adjacent panel pieces, the anchoring element is placed with its wing flanges inserted into the slots of the adjacent panel pieces which face the anchoring element, as illustrated in FIG. 2. A fastener, such as nail 41, is placed with its pointed end positioned by groove 42, and driven home. This causes the nail to pass through the base of the anchoring element and into the support surface. When the nail passes through the base of the anchoring element, it may tend to cause plastic material to be drawn with the nail through the base, and with an accumulation forming on the underside of the of the base. The concave bottom face of the base in the anchoring element provides a space which accommodates such material.

The inwardly facing surfaces of flange portions 34, 36 are provided with an entering set of ridges 44, 46 and another set of ridges 48, 50 located more toward the base of the receptor channel.

With the anchoring elements secured, an elongate cover strip, shown at 52, is mounted in the receptor channel of the anchoring element. Such comprises, and referring to FIG. 3, an elongate piece of U-shaped cross section, which also may be a plastic extrusion. Specifically, the cover strip comprises a web portion 54 and flanges 56, 58 joined to margins of the web portion. The cover strip is mounted in place with its recessed side, which is the underside of the strip in FIG. 3, facing the receptor channel defined along the length of the anchoring element.

Flanges 56, 58 are provided with ridges 60, 62 extending along their outer surfaces adjacent end margins of the flanges. When the cover strip is mounted on the anchoring element, and on the cover strip being forced downwardly within the anchoring element's receptor channel, ridges 60, 62 move past ridges 44, 46, with inward resilient flexing of flanges 56, 58 providing the clearance required. With ridges 60, 62 moved past ridges 48, 50, and the bottom margins of flanges 56, 58 coming up against ridges 48, 50, the cover strip is fully seated. The snap-acting, catch-engaging structure described functions to maintain the cover strip in position.

The cover strip when installed obscures the nailing used in securing the anchoring element. A covering or outer surfacing of the cover strip is selected which makes it esthetically compatible with the adjoining panel pieces.

FIG. 2 illustrates the anchoring element with such anchoring adjacent panel pieces to a flat surface. FIG. 3 illustrates how the anchoring element may be employed to secure adjacent panel pieces to a curving surface.

It will be noted that wing flanges 38, 40 on their undersides and along the length of the flanges are provided with elongate shallow grooves 64, 66. These grooves define bend regions in the wing flanges. Thus, the installer may permanently bend the wing flanges at these locations, to adapt the anchoring element for the installation of panel pieces on a curving surface.

Figure 4:
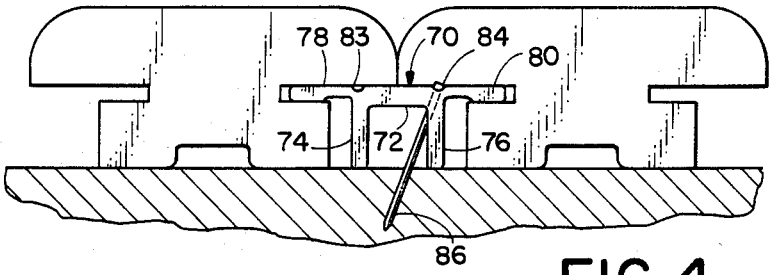
FIG. 4 is a view similar to FIG. 2, but illustrating a modified form of the invention.

In FIG. 4 there is illustrated a modified form of the invention. The anchoring element 70 shown in this figure also takes the form of a generally channel-shaped extrusion, and such may also be a plastic extrusion. The element includes a web portion 72 joining with opposed flange portions 74, 76. In this modification, the channel defined by the flange portions and the web portion faces the supporting surface which mounts the anchoring element.

Also part of the anchoring element are wing flanges 78, 80. These extend laterally outwardly from the element, at approximately the web portion 72. The wing flanges seat within the slots presented along the margins of the adjacent panel pieces secured by the anchoring elements.

The anchoring element in FIG. 4 is provided with longitudinally extending grooves 82, 84 indented inwardly from the top surface thereof. These grooves are used in the positioning of nails which after being positioned are driven home to secure the anchoring element in place. Such a nail is exemplified by nail 86 illustrated.

The panel installation describe is easily and rapidly assembled on a wall surface. A secure mounting for a panel piece is obtained in an attractive wall surfacing. The installation does not employ fasteners which are extended through the panel pieces themselves. A panel installation may be removed from a supporting surface with the panel pieces in reuseable form.

It should be obvious that variations and modifications are possible in the panel installation and elements used to secure the panel pieces to a surface. It is intended to cover all such modifications and variations as come within the spirit and scope of this invention.

It is claimed and desired to secure by Letters Patent:

1. A panel installation on a supporting surface which comprises:

multiple panel pieces having front and back sides one piece beside an adjacent piece and their said front sides facing outwardly, the pieces having essentially parallel opposed side margins, said pieces having slots extending along each of their opposite margins indented laterally inwardly from the margins and said pieces having a shoulder defined at each side margin located between the slot which extends along the margin and the front side of the piece, the shoulders of adjacent pieces being laterally spaced from each other, an elongate anchoring element of generally U-shaped cross section securing adjacent pieces through said margins to said surface, said anchoring element having a base web which is adjacent said surface and opposed upstanding flange portions joined to said base web along opposite margins of the base web to define a receptor channel which faces outwardly from said surface, said anchoring element further having wing flanges joined to said upstanding flange portions forming the top of the element and said wing flanges being disposed below the shoulders of adjacent pieces, the wing flanges extending laterally outwardly and fitting within the slots of adjacent panel pieces, and an elongate cover strip having a top, a bottom, and opposed sides mounted with the sides thereof frictionally seated within the receptor channel defined by said anchoring element and the top thereof filling the space between shoulders of adjacent pieces.

2. The panel installation of claim 1, wherein said cover strip is an elongate piece of generally U-shaped cross section and thus has a recessed bottom extending along the length of the piece, and said cover strip is seated within said receptor channel with the recessed bottom of the cover strip facing the receptor channel.

3. The panel installation of claim 1, wherein the cover strip is an elongate piece including an elongate web portion forming the top thereof and parallel spaced opposed flanges normal to said web portion extending along the web portion joining with opposite margins of the web portion and forming the sides of the cover strip, and said cover strip is mounted with the flanges of the cover strip projecting from said web portion into said channel.

4. The panel installation of claim 3, wherein interengaging catch structure is provided on the outside of the flanges of said cover strip and on the inside of the flange portions of said anchoring element.

5. The panel installation of claim 1, wherein said base web of said anchoring element has a concave face facing the support surface, and said wing flanges have elongate grooves extending therealong providing regions of bend.

6. The panel installation of claim 1, wherein the side margins of the pieces are recessed along the length of the pieces where such meet with the back sides of the pieces, and the back sides of the pieces are grooved.

* * * * *